US010407829B2

(12) United States Patent
Lee

(10) Patent No.: US 10,407,829 B2
(45) Date of Patent: Sep. 10, 2019

(54) ARAMID PAPER, MANUFACTURING METHOD THEREFOR, AND USE THEREOF

(71) Applicant: KOLON INDUSTRIES, INC., Gwacheon-si (KR)

(72) Inventor: Bum-Hoon Lee, Daegu (KR)

(73) Assignee: KOLON INDUSTRIES, INC., Gwacheon-si (KR)

( * ) Notice: Subject to any disclaimer, the term of this patent is extended or adjusted under 35 U.S.C. 154(b) by 3 days.

(21) Appl. No.: 15/577,477

(22) PCT Filed: May 27, 2016

(86) PCT No.: PCT/KR2016/005608
§ 371 (c)(1),
(2) Date: Nov. 28, 2017

(87) PCT Pub. No.: WO2016/190694
PCT Pub. Date: Dec. 1, 2016

(65) Prior Publication Data

US 2018/0142415 A1 May 24, 2018

(30) Foreign Application Priority Data

May 28, 2015 (KR) ..... 10-2015-0074612
May 28, 2015 (KR) ..... 10-2015-0074613
May 28, 2015 (KR) ..... 10-2015-0074614

(51) Int. Cl.
*D21H 13/26* (2006.01)
*D21H 27/30* (2006.01)
*D21G 1/00* (2006.01)
*H01B 3/52* (2006.01)

(52) U.S. Cl.
CPC ..... *D21H 13/26* (2013.01); *D21G 1/00* (2013.01); *D21H 27/30* (2013.01); *H01B 3/52* (2013.01)

(58) Field of Classification Search
USPC ..... 162/157.3
See application file for complete search history.

(56) References Cited

U.S. PATENT DOCUMENTS

| | | | |
|---|---|---|---|
| 3,018,091 | A | 1/1962 | Duggins |
| 3,063,966 | A | 11/1962 | Kwolek et al. |
| 3,133,138 | A | 5/1964 | Alexander, Jr. |
| 3,767,756 | A | 10/1973 | Blades |
| 3,869,430 | A | 3/1975 | Blades |
| 4,698,267 | A | 10/1987 | Tokarsky |
| 5,026,456 | A | 6/1991 | Hesler et al. |
| 5,833,807 | A | 11/1998 | Ramachandran et al. |
| 6,544,622 | B1 | 4/2003 | Nomoto |
| 6,551,456 | B2 | 4/2003 | Wang et al. |
| 7,335,276 | B2 | 2/2008 | Kawka et al. |
| 7,771,810 | B2 | 8/2010 | Levit et al. |
| 8,268,434 | B2 | 9/2012 | Levit |
| 2005/0230072 | A1 | 10/2005 | Levit |
| 2013/0277089 | A1 | 10/2013 | Rolink et al. |
| 2013/0280509 | A1 | 10/2013 | Alvarado Chacon et al. |

FOREIGN PATENT DOCUMENTS

| | | |
|---|---|---|
| EP | 1756360 | 2/2007 |
| JP | 2535418 | 4/1991 |
| JP | 10-046484 | 2/1998 |
| JP | 2003-221794 | 8/2003 |
| JP | 2004-162193 | 6/2004 |
| JP | 2007-532798 | 11/2007 |
| JP | 5591046 | 4/2012 |
| KR | 10-0486050 | 5/2005 |
| KR | 10-2005-0071531 | 7/2005 |
| KR | 10-2009-0091811 | 8/2009 |
| KR | 10-2009-0110031 | 10/2009 |
| KR | 10-2010-0094543 | 8/2010 |
| KR | 10-2013-0133348 | 12/2013 |
| KR | 10-2014-0038935 | 3/2014 |
| KR | 10-2014-0040096 | 4/2014 |
| KR | 10-1515307 | 4/2015 |
| WO | 02/059411 | 8/2002 |
| WO | 2005/10337 | 11/2005 |

*Primary Examiner* — Mark Halpern
(74) *Attorney, Agent, or Firm* — Lex IP Meister, PLLC

(57) ABSTRACT

The present disclosure relates to an aramid paper for a honeycomb, which is prepared by mixing, with an aramid floc, an aramid pulp having a fiber length equal to or longer than a predetermined length and a fibril development equal to or higher than a predetermined level, at a predetermined ratio, a wholly aromatic aramid paper for an electrical insulation paper having superior paper formation property and thus having uniform electrical insulation property, which is prepared by mixing an aramid pulp having a fines content equal to or higher than a predetermined ratio at a predetermined ratio, a laminated aramid paper having a uniform thermal expansion coefficient, uniform electrical conductivity and uniform thermal conductivity, which is prepared by laminating an aramid paper with superior paper formation property on an aramid paper with superior paper strength by calendering, and a method for preparing the same. The aramid paper according to the present disclosure is applicable to a material or a component which requires precision with little difference in physical properties such as a thermal expansion coefficient, electrical conductivity and thermal conductivity. Specifically, it is applicable to a honeycomb, an electrical insulation paper, a PCB substrate, etc. because it has superior paper strength and paper formation property. Moreover, the method for preparing an aramid paper can solve the problems of poor transfer of a base paper, nonuniformity of strength and aggregation between flocs.

2 Claims, No Drawings

ARAMID PAPER, MANUFACTURING METHOD THEREFOR, AND USE THEREOF

This application is a 371 of PCT/KR2016/005608 filed 27 May 2016

TECHNICAL FIELD

The present disclosure relates to an aramid paper, a method for preparing the same and a use thereof.

More specifically, the present disclosure relates to an aramid paper for a honeycomb, which is prepared by mixing, with an aramid floc, an aramid pulp having a fiber length equal to or longer than a predetermined length and a fibril development equal to or higher than a predetermined level, at a predetermined ratio.

The present disclosure also relates to a wholly aromatic aramid paper for an electrical insulation paper having superior paper formation property and thus having uniform electrical insulation property, which is prepared by mixing, with an aramid floc, an aramid pulp having a fiber length equal to or shorter than a predetermined length, a fibril development equal to or higher than a predetermined level and a fines content equal to or higher than a predetermined ratio at a predetermined ratio, and a method for preparing the same.

The present disclosure also relates to a laminated aramid paper having a uniform thermal expansion coefficient, uniform electrical conductivity and uniform thermal conductivity, which is prepared by laminating an aramid paper with superior paper formation property on an aramid paper with superior paper strength by calendering, and a method for preparing the same. More particularly, it relates to a laminated aramid paper prepared by applying a second mixture containing an aramid floc having superior paper formation property and an aramid pulp containing 20 wt % or more fines on a substrate paper having superior paper strength, formed of a first mixture containing an aramid floc and an aramid pulp, and binding the same by calendering, and a method for preparing the same.

The present application claims priority to Korean Patent Application Nos. 10-2015-0074612, 10-2015-0074613 and 10-2015-0074614 filed on May 28, 2015 in the Republic of Korea, the disclosures of which are incorporated herein by reference.

BACKGROUND ART

The representative uses of an industrial paper include honeycombs, electrical insulation papers, separators, filters, etc. The physical properties required for the industrial paper are electrical insulation, mechanical property, light weight, uniformity, porosity, etc., depending on applications. However, above all these requirements, it should have superior paper strength and paper formation property.

As a representative example, a honeycomb using an aramid fiber as an industrial paper is prepared from an aramid paper containing a para-aramid fiber, a pulp and another fibrous material and further containing a binder or a resin coat. As a representative example of the binder used in the preparation of the aramid paper, U.S. Pat. No. 6,551,456B describes that a fibrous paper may be prepared by using a polyester fiber as a binder for an aramid pulp and the paper can improve the impregnation property of a resin for a thermosetting structure. And, KR10-2009-0091811A describes a technology of preparing an aramid paper by using a thermoplastic fiber having a melting temperature above the curing temperature of a matrix resin and a glass transition temperature above 100° C. as a binder. As a representative example of preparation of a paper for a honeycomb through resin coating, KR10-2010-0094543A describes a technology of preparing a paper for a honeycomb from a meta-aramid fibrid using a phenol-, polyimide- or epoxy-based coating agent.

However, because the aramid paper for a honeycomb according to the prior art contains, in addition to the aramid pulp or fibrid, a binder formed of a thermoplastic fiber or resin, which has a weaker strength than the aramid, there is the problem of decreased mechanical property of a base paper or difficulty in reducing weight because of decreased porosity. In addition, there are the problems of poor transfer of a base paper, nonuniformity of strength and aggregation between flocs.

Meanwhile, for an electrical insulation paper used in mobile phones, power cables, etc., heat resistance is required additionally. Therefore, there have been many research and development efforts recently on a sheet formed of an aromatic polyamide (aramid) pulp or fiber as an insulation sheet having superior electrical insulation property and heat resistance and preparation and application thereof. However, because a sheet consisting only of the aramid pulp or fiber has poor flexibility and strength in general, there have been research and development efforts to improve the flexibility and strength by blending the aramid fiber with another fiber by using a binder. In this regard, JP 2535418B discloses an aramid insulation paper wherein aramid and polyester fibers are blended to reduce flexural rigidity. Although flexibility is ensured through this, electrical insulation property and heat resistance are unsatisfactory. Although JP 5591046B improves the heat resistance to some extent by blending polycarbonate and aramid fibers, uniform electrical insulation property is not ensured as compared to the insulation paper consisting only of aramid.

Recently, KR10-2014-0040096A disclosed a technology of preparing an electrical insulation paper by mixing 40-100 wt % of a film-type para-aramid fibrid with an inorganic filler, etc. using a binder via a jet spin process. And, KR10-2014-0038935A disclosed a technology of preparing an electrical insulation paper using an aramid microfilament and an aramid fibrid or pulp as a non-resin-type binder.

However, the electrical insulation paper prepared according to the prior art contains, in addition to the aramid pulp or fibrid, the binder formed of the thermoplastic fiber, inorganic filler, etc. In particular, for the electrical insulation paper, a technology for solving the problems of poor transfer of a base paper, nonuniformity of strength and aggregation between flocs by improving the paper formation property, which is more important for uniform electrical insulation property than the improvement of the strength of the base paper, has not been proposed.

Meanwhile, because it is difficult to achieve satisfactory physical properties with a single layer of an aramid short fiber only, a technology for preparing a laminate using an aramid paper and a polymer is being developed. As a representative example, KR10-2005-0071531A describes a technology of forming an aramid paper through calendering and applying thereon a polyester-based polymer or copolymer.

However, because the aramid paper prepared according to the prior art contains, in addition to the aramid pulp or fibrid, the binder formed of the thermoplastic fiber, inorganic filler, etc., there may be difference in physical properties such as a thermal expansion coefficient, electrical conductivity and thermal conductivity. Accordingly, it is not applicable to a material or a component which requires precision. In addition, it cannot solve the problems of poor transfer of a base paper, nonuniformity of strength and aggregation between flocs.

DISCLOSURE

Technical Problem

The present disclosure is designed to solve the problems of the related art, and therefore the present disclosure is directed to providing a honeycomb with improved physical properties by improving the base paper physical properties of an aramid paper and a method for preparing the same.

The present disclosure is also directed to providing an aramid paper for a honeycomb, wherein an aramid floc and an aramid pulp are mixed at a predetermined ratio.

The present disclosure is also directed to providing an aramid paper for a honeycomb, which is prepared by mixing, together with an aramid floc, an aramid pulp having a fiber length equal to or longer than a predetermined length and a fibril development equal to or higher than a predetermined level at a predetermined ratio.

The present disclosure is also directed to providing an aramid paper for a honeycomb, which solves the problems of poor transfer of a base paper, nonuniformity of strength and aggregation between flocs, and a method for preparing the same.

The present disclosure is also directed to providing a wholly aromatic aramid paper for an electrical insulation paper, which has uniform electrical insulation property by improving the paper formation property of an aramid base paper, and a method for preparing the same.

The present disclosure is also directed to providing a wholly aromatic aramid paper for an electrical insulation paper, which is prepared by mixing, together with an aramid floc, an aramid pulp having a fiber length equal to or shorter than a predetermined length, a fibril development equal to or higher than a predetermined level and a fines content equal to or higher than a predetermined ratio at a predetermined ratio, and a method for preparing the same.

The present disclosure is also directed to providing a wholly aromatic aramid paper for an electrical insulation paper, which solves the problems of poor transfer of a base paper, nonuniformity of strength and aggregation between flocs, and a method for preparing the same.

The present disclosure is also directed to providing a laminated aramid paper having a uniform thermal expansion coefficient, electrical conductivity and thermal conductivity, which is prepared by laminating an aramid paper having a superior paper formation property on an aramid paper having superior paper strength by calendering, and a method for preparing the same.

The present disclosure is also directed to providing a laminated aramid paper having a superior paper formation property, which is prepared by binding an aramid pulp containing fines at or above a predetermined ratio on a substrate paper having a superior paper strength, formed of an aramid floc and an aramid pulp, by calendering, and a method for preparing the same.

The present disclosure is also directed to providing a laminated aramid paper having a uniform thermal expansion coefficient, electrical conductivity and thermal conductivity, which is prepared by laminating aramid papers having different physical properties, which are prepared from aramid short fibers only without using a binder such as a polymer, a resin, etc., by calendering, and a method for preparing the same.

The aramid paper according to the present disclosure may be prepared by applying a second mixture containing an aramid floc and an aramid pulp containing 20 wt % or more fines on one or more of the top portion and the bottom portion of a substrate paper formed of a first mixture containing an aramid floc and an aramid pulp having a length of 0.5-0.8 mm and a freeness of 150-250 mL and binding the same by calendering.

The first mixture may contain 20-40 wt % of an aramid floc and 60-80 wt % of an aramid pulp.

The aramid pulp containing 20 wt % or more fines may be prepared by beating an aramid floc mixture of 10-20 wt % of a floc having a length equal to or longer than 3 mm and shorter than 6 mm and 80-90 wt % of a floc having a length equal to or longer than 6 mm and equal to or shorter than 8 mm with a beater equipped with a refiner.

The method for preparing an aramid paper according to the present disclosure may include: a step of preparing a substrate paper from a first mixture of an aramid floc and aramid pulp having a length of 0.5-0.8 mm and a freeness of 150-250 mL; a step of applying a second mixture containing an aramid floc and an aramid pulp containing 20 wt % or more fines on the substrate paper; and a step of binding the substrate paper with the applied second mixture by calendering.

The substrate paper may be prepared by sheeting a first mixture of 20-40 wt % of an aramid floc and 60-80 wt % of an aramid pulp.

And, the aramid pulp containing 20 wt % or more fines may be prepared by beating an aramid floc mixture of 10-20 wt % of a floc having a length equal to or longer than 3 mm and shorter than 6 mm and 80-90 wt % of a floc having a length equal to or longer than 6 mm and equal to or shorter than 8 mm with a beater equipped with a refiner.

Technical Solution

Because the physical properties of a honeycomb originate from the physical properties of a base paper, a base paper for a honeycomb should have superior strength. However, because the existing base paper for a honeycomb using an aramid short fiber contains, in addition to an aramid pulp, floc or fibrid, a binder formed of a thermoplastic fiber or resin, which has a weaker strength than the aramid, there is the problem of decreased mechanical property of the base paper or difficulty in reducing weight because of decreased porosity. In addition, there are the problems of poor transfer of a base paper, nonuniformity of strength and aggregation between flocs.

In order to improve the physical properties of a honeycomb, the present disclosure provides an aramid paper having an improved strength of a base paper without using a binder by using a para-aramid pulp, particularly one exhibiting a long fiber length and a fibril development, together with an aramid floc and a method for preparing the same.

For an electrical insulation paper, a superior paper formation property is more needed to ensure a uniform electrical insulation property than the strength of the base paper. However, the existing electrical insulation paper using an aramid short fiber necessarily contains, in addition to an aramid pulp or fibrid, a binder formed of a thermoplastic fiber, inorganic filler, etc. In particular, for the electrical insulation paper, a technology for solving the problems of poor transfer of a base paper, nonuniformity of strength and aggregation between flocs by improving the paper formation property, which is more important for uniform electrical insulation property than the improvement of the strength of the base paper, has not been proposed.

Accordingly, the present disclosure provides a wholly aromatic aramid paper for an electrical insulation paper having improved paper formation property and capable of providing uniform electrical insulation property of a base paper, which is prepared by mixing, together with a para-aramid floc, an aramid pulp having a fiber length equal to or shorter than a predetermined length, a fibril development equal to or higher than a predetermined level and a fines content equal to or higher than a predetermined ratio at a predetermined ratio, and a method for preparing the same.

Because the existing industrial base paper using the aramid short fiber necessarily contains, in addition to an aramid pulp, floc or fibrid, a binder formed of a thermoplastic fiber or resin, which has a weaker strength than the aramid, there is the problem of decreased mechanical property of the base paper or difficulty in reducing weight because of decreased porosity. In addition, there are the problems of poor transfer of a base paper, nonuniformity of strength and aggregation between flocs. And, when the aramid paper having a superior paper strength is prepared using a pulp having a long fiber length, the paper formation property is unsatisfactory because of relatively high porosity.

Accordingly, in order to solve this problem, the present disclosure provides an aramid paper, which is prepared by applying a pulp having a short fiber length and a high fines content on an aramid paper having a superior paper strength as a substrate paper without using a binder and then filling the pores with the fines through calendering, and a method for preparing the same. Because the aramid paper has superior paper formation property on one side, it can be used for various applications.

Advantageous Effects

An aramid paper for a honeycomb according to the present disclosure improves the mechanical properties of a base paper and reduces the weight of a honeycomb by improving porosity and structure. In addition, it can solve the problems of poor transfer of the base paper, nonuniformity of strength and aggregation between flocs.

A wholly aromatic aramid paper for an electrical insulation paper according to the present disclosure has superior paper formation property and, therefore, can provide uniform electrical insulation property, improve mechanical property and reduce weight through structural improvement of a base paper. In addition, it can solve the problems of poor transfer of the base paper, nonuniformity of strength and aggregation between flocs.

Because a laminated aramid paper according to the present disclosure consists only of an aramid short fiber without a binder such as a polymer, synthetic resin, etc., it is applicable to a material or a component which requires precision with little difference in physical properties such as a thermal expansion coefficient, electrical conductivity and thermal conductivity. More specifically, it is applicable to a honeycomb, an electrical insulation paper, a PCB substrate, etc. because it has superior paper strength and paper formation property. Moreover, the method for preparing an aramid paper can solve the problems of poor transfer of a base paper, nonuniformity of strength and aggregation between flocs.

BEST MODE

An aramid paper for a honeycomb according to the present disclosure may contain a mixture of an aramid floc and an aramid pulp.

The mixture may contain 20-40 wt % of an aramid floc and 60-80 wt % of an aramid pulp.

The aramid floc may have a length of 4-8 mm and the aramid pulp may have a length of 0.5-8 mm and a freeness of 150-250 mL.

A method for preparing an aramid paper for a honeycomb according to the present disclosure may include: a step of preparing an aramid floc; a step of preparing an aramid pulp; a step of preparing a paper stock by mixing the aramid floc and the aramid pulp at a ratio of 20:80 to 40:60; and a step of forming the paper stock into a base paper.

The aramid floc may have a length of 4-8 mm and the aramid pulp may have a length of 0.5-8 mm and a freeness of 150-250 mL.

A wholly aromatic aramid paper for an electrical insulation paper according to the present disclosure may contain a mixture of an aramid floc and an aramid pulp containing 20 wt % or more fines.

The mixture may contain 20-40 wt % of an aramid floc and 60-80 wt % of an aramid pulp.

The aramid floc may have a length of 4-8 mm and the aramid pulp may have a length of 0.5-8 mm and a freeness of 150-250 mL.

A method for preparing a wholly aromatic aramid paper for an electrical insulation paper according to the present disclosure may include: a step of preparing an aramid floc; a step of preparing an aramid pulp containing 20 wt % or more fines; a step of preparing a paper stock by mixing the aramid floc and the aramid pulp at a ratio of 20:80 to 40:60; and a step of forming the paper stock into a base paper.

The aramid floc may have a length of 4-8 mm and the aramid pulp may have a length of 0.5-8 mm and a freeness of 150-250 mL.

An aramid paper according to the present disclosure may be prepared by applying a second mixture containing an aramid floc and an aramid pulp containing 20 wt % or more fines on one or more of the top portion and the bottom portion of a substrate paper formed of a first mixture containing an aramid floc and an aramid pulp having a length of 0.5-0.8 mm and a freeness of 150-250 mL and binding the same by calendering.

The first mixture may contain 20-40 wt % of an aramid floc and 60-80 wt % of an aramid pulp.

The aramid pulp containing 20 wt % or more fines may be prepared by beating an aramid floc mixture of 10-20 wt % of a floc having a length equal to or longer than 3 mm and shorter than 6 mm and 80-90 wt % of a floc having a length equal to or longer than 6 mm and equal to or shorter than 8 mm with a beater equipped with a refiner.

A method for preparing an aramid paper according to the present disclosure may include: a step of preparing a substrate paper from a first mixture of an aramid floc and aramid pulp having a length of 0.5-0.8 mm and a freeness of 150-250 mL; a step of applying a second mixture containing an aramid floc and an aramid pulp containing 20 wt % or more fines on the substrate paper; and a step of binding the substrate paper with the applied second mixture by calendering.

The substrate paper may be prepared by sheeting a first mixture of 20-40 wt % of an aramid floc and 60-80 wt % of an aramid pulp.

The aramid pulp containing 20 wt % or more fines may be prepared by beating an aramid floc mixture of 10-20 wt % of a floc having a length equal to or longer than 3 mm and shorter than 6 mm and 80-90 wt % of a floc having a length equal to or longer than 6 mm and equal to or shorter than 8 mm with a beater equipped with a refiner.

MODE FOR DISCLOSURE

The present disclosure relates to an aramid paper having an improved strength of a base paper without using a binder by using a para-aramid pulp, particularly one exhibiting a long fiber length and a fibril development, together with an aramid floc and a method for preparing the same.

The present disclosure also relates to a wholly aromatic aramid paper for an electrical insulation paper having superior paper formation property and thus having uniform electrical insulation property, which is prepared by mixing, with an aramid floc, an aramid pulp having a fiber length equal to or shorter than a predetermined length, a fibril development equal to or higher than a predetermined level and a fines content equal to or higher than a predetermined ratio at a predetermined ratio, and a method for preparing the same.

The present disclosure also relates to a laminated aramid paper having superior paper strength and superior paper formation property, which is prepared by preparing an aramid substrate paper with improved strength of a base paper by using a para-aramid pulp, particularly a pulp exhibiting a long fiber length and fibril development, together with an aramid floc without using a binder, applying a mixture containing a para-aramid floc and an aramid pulp having a fiber length equal to or shorter than a predetermined length, a fibril development equal to or higher than a predetermined level and a fines content equal to or higher than a predetermined ratio at a predetermined ratio on the prepared substrate paper, and binding the same by calendering, and a method for preparing the same.

It should be understood that the terms or words used in the specification and the appended claims should not be construed as limited to general and dictionary meanings, but interpreted based on the meanings and concepts corresponding to technical aspects of the present disclosure on the basis of the principle that the inventor is allowed to define terms appropriately for the best explanation.

A "fiber" refers to a relatively flexible material which has a large length-to-width ratio along a cross section perpendicular to the length and is changed interchangeable with the term "filament". In the present disclosure, the cross section of the filament may have any arbitrary shape, but it is typically circular or bean-shaped. A fiber spun onto a bobbin in a package is referred to as a continuous fiber. A fiber can be cut into short lengths called staple fibers. A fiber can be cut into even shorter lengths called flocs. A yarn, a multifilament yarn or a tow consists of a plurality of fibers. A yarn can be intertwined and/or twisted.

A "staple fiber" can be prepared by cutting a filament to a length of 15 cm or shorter, specifically 3-15 cm, most specifically 3-8 cm. The staple fiber may be straight (i.e., non-crimped) or may be crimped to have a sawtooth-shaped along the length of the staple fiber with any crimp (or repeating bend) frequency. The fiber can be present in an uncoated, coated or pretreated (e.g., pre-stretched or heat-treated) form.

An "aramid" refers to a wholly aromatic polyamide. Chemically, it is defined as a linear synthetic polymer wherein 60 mol % or more bonds connecting benzene rings are amide groups. The aramid is classified into para-aramid, meta-aramid and a copolymer thereof depending on the position where amide groups are located in the benzene rings. Examples of para-aramid include poly(p-phenylene terephthalamide) and a copolymer thereof, poly(p-phenylene)-co-poly(3,4-diphenyl ether)terephthalamide, etc. Examples of meta-aramid include poly(m-phenylene isophthalamide) and a copolymer thereof. Specifically, para-aramid may be used in the present disclosure.

An "aramid pulp" refers to a pulp prepared from aramid. The aramid pulp may be prepared by dispersing aramid in water and then sheeting using a sheeting machine. In order to improve mechanical properties, the dispersed short fibers are fibrilized by beating, etc.

More specifically, the aramid pulp preparation and fibrilization are performed as follows. First, an aramid short fiber of a predetermined length is prepared by cutting a crimped aramid filament using a rotary cutter. Then, the aramid short fiber is washed with water to remove impurities such as fine dusts, oils, etc., specifically at temperatures above room temperature for easy removal of the impurities.

Then, the washed aramid short fiber is dispersed in water and prepared into a homogeneous slurry. Specifically, this dissociation process may be performed at temperatures above room temperature in order to remove remaining oils, etc. and to improve the dispersibility of the aramid short fiber. Through the dissociation process, each aramid short fiber is separated into a plurality of monofilaments. Specifically, the slurry may contain 1.0-2.0 wt % of the aramid short fiber.

Subsequently, the slurry homogenously dispersed in water is beaten. During the beating process, using a refiner, the aramid short fiber is separated, cut and fibrilized into a fibrilized aramid short fiber having an average length of 0.5-5 mm.

Optionally, if the fibrilization of the aramid short fiber is not achieved as desired, the dissociation process and the beating process may be performed repeatedly.

Through the beating process, the slurry containing the fibrilized aramid short fiber is prepared into a sheet. The sheet is squeezed to remove water and then dried to further remove water. The dried sheet is crushed to prepare an aramid pulp.

The beating process is one of important processes that determine the freeness (Canadian standard freeness) of the aramid pulp. It is because the freeness of the aramid pulp varies greatly depending on the degree of fibrilization of the aramid short fiber through the beating process. A good degree of fibrilization leads to a low freeness of the pulp, which means that the aramid pulp has superior dispersibility. On the contrary, a poor degree of fibrilization leads to a high freeness of the pulp, which means that the aramid pulp has poor dispersibility. In addition, it is important that the aramid pulp has uniform physical properties. If the fibrilization is nonuniform, the variation of the freeness is increased. A large variation of the freeness leads to significant difference in the physical properties of the final product, which results in an increased defect rate.

A "fibrid" refers to a non-granular, fibrous or film-like particle. Specifically, it may have a melting point or a decomposition temperature of 320° C. or above. The fibrid is not a fiber but a fibroid material in that it has a fiber-like region connected via a web. The fibrid has an aspect ratio of 5:1 to 10:1 and an average length of 0.2-1.0 mm. The web of the fibrid is smaller than 1 or 2 μm, typically 1 μm or smaller in thickness. Before being dried, the fibrid can be used in wet state and can be deposited as a binder physically entwined about other components of a product. The fibrid can be prepared by any method including one using a fibridating apparatus of the type disclosed in U.S. Pat. No. 3,018,091 wherein a polymer solution is precipitated and sheared in a single step.

A "fibril" refers to a small fiber having a diameter as small as a fraction of 1 μm to a few micrometers and having a length of about 10-100 μm. The fibril generally extends from the main trunk of a larger fiber having a diameter of 4-50 μm. The fibril acts as a hook or a fastener to ensnare and capture an adjacent material. Some fibers are fibrilized, but others are not fibrilized or are not fibrilized effectively. In the latter case, the fiber is not fibrilized. The poly(p-phenylene terephthalamide) fiber is easily fibrilized upon abrasion, creating fibrils. The poly(p-phenylene isophthalamide) fiber is not fibrilized.

An "aramid floc" means an unfibrilized short aramid fiber prepared from cutting of a continuous filament. The aramid floc has a length of 1-50 mm in general. If the length is shorter than 1 mm, the effect of reinforcing a sheet is decreased. And, if the length is longer than 50 mm, entanglement may occur during the formation of a sheet. The aramid floc is prepared by cutting an aramid fiber into short lengths without significant or any fibrilization, such as those prepared by the methods described in U.S. Pat. Nos. 3,063,966, 3,133,138, 3,767,756 and 3,869,430.

According to the experiments conducted by the inventors of the present disclosure, transfer of a base paper was difficult and nonuniform strength was observed when a floc having a length of 3 mm or smaller was used. And, aggregation between flocs occurred when the length was 9 mm or larger. Accordingly, an aramid floc having a length of 4-8 mm may be used to prepare an aramid paper for a honeycomb, an aramid paper for an electrical insulation paper and a substrate paper formed of a first mixture containing an aramid floc and an aramid pulp.

More specifically, when preparing the aramid paper for a honeycomb, the aramid paper for an electrical insulation paper and the a substrate paper formed of a first mixture containing an aramid floc and an aramid pulp, a mixture of 60-80 wt % of an aramid pulp and 20-40 wt % of an aramid floc may be used.

According to the experiments conducted by the inventors of the present disclosure, transfer of a base paper was difficult and nonuniform strength was observed if a floc having a length of 3 mm or smaller was used when preparing a second mixture containing an aramid floc and an aramid pulp containing 20 wt % or more fines. And, aggregation between flocs occurred when the length was 9 mm or larger. Accordingly, an aramid floc having a length of 4-8 mm may be used to prepare the second mixture.

"Fines" refer to pulps with short lengths separated sequentially using Tyler screens 28 (0.595 mm), 48 (0.297 mm), 100 (0.149 mm), 150 (0.105 mm) or 200 (0.074 mm) as defined by TAPPI (Technical Association of Pulp and Paper Industry) T233 cm-95. More specifically, the fiber length of pulps are classified according to TAPPI T233 cm-95 as follows. TAPPI T233 cm-95 is for measuring the weighted average fiber length of a pulp. For a fiber having a length of 1 mm and a weight of w mg, the weighted average length L is defined as $\Sigma(wl)/\Sigma w$. Use of either a Clark type or Bauer-McNett type classifier will produce identical results for the classification of fibers according to length. Fibers are classified according to length by separating the fibers using the coarsest screen and then sequentially with finer screens. The openings of the commonly used Tyler screens are described in Table 1 and the combinations of screen openings commonly used for classification of fibers according to length are as follows.

1) Long-fibered pulps: Tyler screens 10 (1.68 mm), 14 (1.19 mm), 28 (0.595 mm) and 48 (0.297 mm)

2) Medium-fibered pulps: Tyler screens 14 (1.19 mm), 28 (0.595 mm), 48 (0.297 mm) and 100 (0.149 mm)

3) Short-fibered pulps: Tyler screens 28 (0.595 mm), 48 (0.297 mm), 100 (0.149 mm), 150 (0.105 mm) and 200 (0.074 mm)

TABLE 1

| Tyler series | Opening, mm | U.S. standard |
|---|---|---|
| 10 | 1.68 | 12 |
| 12 | 1.41 | 14 |
| 14 | 1.19 | 16 |
| 20 | 0.841 | 20 |
| 28 | 0.595 | 30 |
| 35 | 0.420 | 40 |
| 48 | 0.297 | 50 |
| 65 | 0.210 | 70 |
| 100 | 0.149 | 100 |
| 150 | 0.105 | 140 |
| 200 | 0.074 | 200 |

The aramid pulp having a fines content equal to or higher than a predetermined value according to the present disclosure is prepared by beating an aramid floc mixture containing aramid flocs with different lengths at a predetermined ratio with a beater equipped with a refiner.

Hereinafter, the aramid paper for a honeycomb, the aramid paper for an electrical insulation paper, the laminated aramid paper and the methods for preparing the same according to the present disclosure are described in detail referring to examples.

Preparation Example 1: Preparation of Aramid Floc

An aromatic diamine solution was prepared by dissolving 80 kg of calcium chloride and 48.67 kg of p-phenylenediamine in 1,000 kg of N-methyl-2-pyrrolidone maintained at 80° C. After adding the aromatic diamine solution and equimolar molten terephthaloyl chloride into a polymerization reactor, a poly(p-phenylene terephthalamide) polymer with an intrinsic viscosity of 6.8 was prepared by stirring the same.

Next, the prepared polymer was dissolved in 99% sulfuric acid to prepare an optically anisotropic spinning dope with a polymer content of 18 wt %. The prepared spinning dope was spun using a spinneret and then coagulated in a coagulation tank through an air layer to prepare a filament. The filament was washed with water, dried and then winded using a winder. Thus obtained poly(p-phenylene terephthalamide) filament was cut to a predetermined length (3, 6 and 9 mm) using a rotary cutter for use as an aramid floc.

Preparation Example 2: Preparation of Aramid Pulp

A homogeneous slurry was prepared by dispersing 20 kg of the 6-mm-long aramid floc prepared in Preparation Example 1 in 1,000 L of water. The prepared slurry was beaten for a predetermined time using a beater equipped with a refiner. The beating process was performed while controlling the basic physical properties of an aramid pulp such as specific surface area (SSA), Canadian standard freeness (CSF), fiber length (FL), etc. through sampling. After the beating process, the slurry was dehydrated using a filter and then dried. The dried sheet was crushed into small pieces to prepare an aramid pulp.

Preparation Example 3: Preparation of Aramid Pulp Having Fines Content of 20% or Higher A homogeneous slurry was prepared by dispersing 20 kg of an aramid floc mixture of 10-20 wt % of the 3-mm-long floc and 80-90 wt % of the floc with a length of 6 mm or longer from among the aramid flocs with different lengths prepared in Preparation Example 1 in 1,000 L of water. The prepared slurry was beaten for a predetermined time using a beater equipped with a refiner. The beating process was performed while controlling the basic physical properties of an aramid pulp such as specific surface area (SSA), Canadian standard freeness (CSF), fiber length (FL), etc. through sampling. After the beating process, the slurry was dehydrated using a filter and then dried. The dried sheet was crushed into small pieces to prepare an aramid pulp. The aramid pulp had a fines content of 20% or higher as measured according to the method of TAPPI (Technical Association of Pulp and Paper Industry) T233 cm-95.

Example 1-1: Preparation of Aramid Paper for Honeycomb

A homogeneous slurry was prepared by dispersing 3 kg of the 6-mm-long aramid floc prepared in Preparation Example 1 and 7 kg of the aramid pulp prepared in Preparation Example 2 in 1,000 L of water. The prepared slurry was prepared into a sheet and then dehydrated in a squeezing roll. The dehydrated sheet was dried at 105° C. using a Yankee dryer at a speed of 5 m/min. Then, an aramid paper for a honeycomb with a basis weight of 50 g/m$^2$ was prepared at a speed of 3 m/min using a hot roller at 250° C.

Comparative Example 1-1

An aramid paper for a honeycomb was prepared in the same manner as in Example 1-1 except that the 3-mm- and 9-mm-long aramid flocs were used.

Comparative Example 2-1

An aramid paper for a honeycomb was prepared in the same manner as in Example 1-1 except that 5 kg of the aramid floc and 5 kg of the aramid pulp were used.

Example 1-2: Preparation of Aramid Paper for Electrical Insulation Paper

A homogeneous slurry was prepared by dispersing 3 kg of the 6-mm-long aramid floc prepared in Preparation Example 1 and 7 kg of the aramid pulp having a fines content of 20% or higher prepared in Preparation Example 3 in 1,000 L of water. The prepared slurry was prepared into a sheet and then dehydrated in a squeezing roll. The dehydrated sheet was dried at 105° C. using a Yankee dryer at a speed of 5 m/min. Then, an aramid paper for an electrical insulation paper with a basis weight of 250 g/m$^2$ was prepared at a speed of 3 m/min using a hot roller at 250° C.

Comparative Example 1-2

A homogeneous slurry was prepared by dispersing 3 kg of the 6-mm-long aramid floc prepared in Preparation Example 1 and 7 kg of the aramid pulp prepared in Preparation Example 2, which did not pass through the process of increasing fines content, in 1,000 L of water. The prepared slurry was prepared into a sheet and then dehydrated in a squeezing roll. The dehydrated sheet was dried at 105° C. using a Yankee dryer at a speed of 5 m/min. Then, an aramid paper for an electrical insulation paper with a basis weight of 250 g/m$^2$ was prepared at a speed of 3 m/min using a hot roller at 250° C.

Comparative Example 2-2

An aramid paper for an electrical insulation paper was prepared in the same manner as in Example 1-2 except that the 3-mm and 9-mm-long aramid flocs were used.

Comparative Example 3-2

An aramid paper for an electrical insulation paper was prepared in the same manner as in Example 1-2 except that 5 kg of the aramid floc and 5 kg of the aramid pulp were used.

Example 1-3: Preparation of Laminated Aramid Paper

A homogeneous slurry was prepared by dispersing 3 kg of the 6-mm-long aramid floc prepared in Preparation Example 1 and 7 kg of the aramid pulp prepared in Preparation Example 2 in 1,000 L of water. The prepared slurry was prepared into a sheet and then dehydrated in a squeezing roll to prepare a substrate paper with a basis weight of 50 g/m$^2$.

A homogeneous slurry was prepared by dispersing 3 kg of the 6-mm-long aramid floc prepared in Preparation Example 1 and 7 kg of the aramid pulp having a fines content of 20% or higher prepared in Preparation Example 3 in 1,000 L of water. After applying the prepared slurry on the substrate paper, the slurry was prepared into a sheet and then dehydrated in a squeezing roll. The dehydrated sheet was dried at 105° C. using a Yankee dryer at a speed of 5 m/min. Then, a laminated aramid paper with a basis weight of 100 g/m$^2$ was prepared at a speed of 3 m/min using a hot roller at 250° C.

Comparative Example 1-3

A homogeneous slurry was prepared by dispersing 3 kg of the 6-mm-long aramid floc prepared in Preparation Example 1 and 7 kg of the aramid pulp prepared in Preparation Example 2 (which did not pass through the process of increasing fines content) in 1,000 L of water. The prepared slurry was prepared into a sheet and then dehydrated in a squeezing roll. The dehydrated sheet was dried at 105° C. using a Yankee dryer at a speed of 5 m/min. Then, an aramid paper with a basis weight of 100 g/m$^2$ was prepared at a speed of 3 m/min using a hot roller at 250° C.

Comparative Example 2-3

A homogeneous slurry was prepared by dispersing 3 kg of the 6-mm-long aramid floc prepared in Preparation Example 1 and 7 kg of the aramid pulp having a fines content of 20% or higher prepared in Preparation Example 3 in 1,000 L of water. The prepared slurry was prepared into a sheet and then dehydrated in a squeezing roll. The dehydrated sheet was dried at 105° C. using a Yankee dryer at a speed of 5 m/min. Then, an aramid paper with a basis weight of 100 g/m$^2$ was prepared at a speed of 3 m/min using a hot roller at 250° C.

Comparative Example 3-3

A laminated aramid paper was prepared in the same manner as in Example 1-3 except that calendering was performed using the 3-mm and 9-mm-long aramid flocs.

Comparative Example 4-3

A laminated aramid paper was prepared in the same manner as in Example 1-3 except that calendering was performed using 5 kg of the aramid floc and 5 kg of the aramid pulp.

Evaluation of Physical Properties

1) Measurement of Specific Surface Area (SSA)

Specific surface area (m$^2$/g) was measured by nitrogen adsorption according to the BET method.

2) Measurement of Fiber Length (FL)

Weighted average length was measured using the "Fiber-Expert" tabletop analyzer (available from Metoso Automation in Helsinki, Finland; also known as "PulpExpert FS"). The pulp image was acquired with a digital CCD camera while the pulp slurry passed through the analyzer and the weighted average length was calculated by analyzing the image with a computer.

3) Measurement of Degree of Fibrilization (DF)

The degree of fibrilization (DF) was measured using the "FiberExpert" tabletop analyzer (available from Metoso Automation in Helsinki, Finland; also known as "PulpExpert FS").

4) Measurement of Canadian Standard Freeness (CSF)

Canadian standard freeness (CSF) is a well-known measure of water drainage of particles from a slurry or a dispersion. The freeness was measured according to TAPPI T227. The data acquired from the test are represented as the Canadian standard freeness which means the amount of water (mL) drained from an aqueous slurry under a specific condition. A large value indicates high freeness and water drainage. A small value indicates slow drainage from a dispersion. Because the presence of a larger number of fibrils decreases drainage of water through a paper mat, the freeness is inversely proportional to the degree of fibrilization of a pulp.

5) Measurement of Fines Content (TAPPI T233 cm-95)

An aramid pulp having a fines content equal to or higher than a predetermined value according to the present disclosure was prepared by beating an aramid floc mixture of 10-20 wt % of a floc having a length equal to or longer than 3 mm and shorter than 6 mm and 80-90 wt % of a floc having a length equal to or longer than 6 mm and equal to or shorter than 8 mm with a beater equipped with a refiner. The prepared aramid pulp was separated into short pulps using sequentially Tyler screens 28 (0.595 mm), 48 (0.297 mm), 100 (0.149 mm), 150 (0.105 mm) and 200 (0.074 mm). The separated pulp had a fines content of 20 wt % or higher as measured according to TAPPI (Technical Association of Pulp and Paper Industry) T233 cm-95.

A result of measuring the physical properties of the aramid papers for a honeycomb prepared in Example 1-1 and Comparative Examples 1-1 and 2-1 is given in Table 2.

TABLE 2

| | Basis weight | Thickness | Density | Strength (N/mm$^2$) | |
|---|---|---|---|---|---|
| | (g/m$^2$) | (mm) | (g/cm$^3$) | MD | CD |
| Example 1-1 | 54 | 0.54 | 1.24 | 12.6 | 16.5 |
| Comparative Example 1-1 | 51 | 0.61 | 1.14 | 5.4 | 10.4 |
| Comparative Example 2-1 | 52 | 0.58 | 1.18 | 4.9 | 8.2 |

As seen from Table 2, the aramid paper for a honeycomb prepared from 70 wt % of an aramid pulp having a long fiber length and exhibiting high fibril development and 30 wt % of a 6-mm-long aramid floc through the refining process exhibited superior base paper strength.

Meanwhile, transfer of a base paper was difficult and nonuniform strength was observed when a floc having a length of 3 mm or smaller was used. And, aggregation between flocs occurred when the length was 9 mm or larger. Accordingly, it can be seen that use of an aramid floc having a length of 4-8 mm is preferred in preparing an aramid paper for a honeycomb.

In addition, because strength was decreased when the aramid pulp content was 50% or lower, it can be seen that it is preferred to use a mixture of 60-80 wt % of the aramid pulp and 20-40 wt % of the aramid floc.

A result of measuring the physical properties of the aramid papers for an electrical insulation paper prepared in Example 1-2 and Comparative Examples 1-2 to 3-2 is given in Table 3.

TABLE 3

| | Basis weight | Thickness | Density | Strength (N/mm$^2$) | | Dielectric strength |
|---|---|---|---|---|---|---|
| | (g/m$^2$) | (mm) | (g/cm$^3$) | MD | CD | (kV/min) |
| Example 1-2 | 253 | 0.238 | 1.15 | 15.6 | 16.5 | 6.4 |
| Comparative Example 1-2 | 251 | 0.252 | 1.02 | 6.9 | 11.6 | 5.6 |
| Comparative Example 2-2 | 248 | 0.258 | 0.98 | 4.2 | 10.4 | 5.3 |
| Comparative Example 3-2 | 254 | 0.232 | 1.2 | 3.9 | 8.5 | 5.9 |

As seen from Table 3, the aramid paper for an electrical insulation paper prepared from 70 wt % of an aramid pulp exhibiting fibril development and having a fines content of 20% or higher and 30 wt % of a 6-mm-long aramid floc through the refining process exhibited superior dielectric strength.

Meanwhile, transfer of a base paper was difficult and nonuniform strength was observed when a floc having a length of 3 mm or smaller was used. And, aggregation between flocs occurred when the length was 9 mm or larger. Accordingly, it can be seen that use of an aramid floc having a length of 4-8 mm is preferred in preparing an aramid paper for an electrical insulation paper.

In addition, because strength was decreased when the aramid pulp content was 50% or lower, it can be seen that it is preferred to use a mixture of 60-80 wt % of the aramid pulp and 20-40 wt % of the aramid floc.

A result of measuring the physical properties of the aramid papers prepared in Example 1-3 and Comparative Examples 1-3 to 4-3 is given in Table 4.

TABLE 4

| | Basis weight ($g/m^2$) | Thickness (mm) | Density ($g/cm^3$) | Strength ($N/mm^2$) MD | Strength ($N/mm^2$) CD | Dielectric strength (kV/min) |
|---|---|---|---|---|---|---|
| Example 1-3 | 112 | 1.04 | 1.25 | 25.1 | 29.5 | 8.4 |
| Comparative Example 1-3 | 104 | 1.01 | 1.14 | 11.2 | 20.4 | 7.6 |
| Comparative Example 2-3 | 101 | 1.08 | 1.04 | 12.4 | 24.3 | 6.3 |
| Comparative Example 3-3 | 108 | 1.07 | 1.16 | 18.4 | 24.5 | 6.9 |
| Comparative Example 4-3 | 110 | 1.05 | 1.08 | 21.5 | 26.6 | 7.8 |

As seen from Table 4, the aramid paper prepared by using the paper prepared using a 6-mm-long floc and a pulp having a long fiber length and exhibiting fibril development as a substrate paper, applying a pulp having a short fiber length, exhibiting fibril development and having a fines content of 20% or higher and then binding the same through calendering showed superior strength and CSF as compared to the substrate paper or the paper using the pulp containing fines.

In addition, the laminated aramid paper prepared using 70 wt % of an aramid pulp having a long fiber length and exhibiting fibril development and 30 wt % of a 6-mm-long aramid floc through the refining process exhibited superior physical properties.

INDUSTRIAL APPLICABILITY

An aramid paper according to the present disclosure is applicable to a material or a component which requires precision with little difference in physical properties such as a thermal expansion coefficient, electrical conductivity and thermal conductivity. Specifically, it is applicable to a honeycomb, an electrical insulation paper, a PCB substrate, etc. because it has superior paper strength and paper formation property. Moreover, the method for preparing an aramid paper can solve the problems of poor transfer of a base paper, nonuniformity of strength and aggregation between flocs.

What is claimed is:

1. An aramid paper prepared by applying a second mixture comprising an aramid floc and an aramid pulp comprising 20 wt % or more fines on one or more of a top portion and a bottom portion of a substrate paper formed of a first mixture comprising an aramid floc and an aramid pulp having a length of 0.5-0.8 mm and a freeness of 150-250 mL and binding the same by calendering, wherein the aramid pulp comprising 20 wt % or more fines is prepared by beating an aramid floc mixture of 10-20 wt % of a floc having a length equal to or longer than 3 mm and shorter than 6 mm and 80-90 wt % of a floc having a length equal to or longer than 6 mm and equal to or shorter than 8 mm with a beater equipped with a refiner.

2. The aramid paper according to claim 1, wherein the first mixture comprises 20-40 wt % of an aramid floc and 60-80 wt % of an aramid pulp.

* * * * *